United States Patent [19]

Applebaum et al.

[11] Patent Number: 4,478,148

[45] Date of Patent: Oct. 23, 1984

[54] MISSILE DELIVERED EXPLOSIVE SOUND SYSTEM

[75] Inventors: Albert Applebaum, Silver Spring; Albert S. Will, Bethesda; Samuel A. Humphrey; Frank C. McLean, both of Silver Spring; Sylvan Wolf, Hyattsville; Carl R. Peterson; Harry J. Gauzza, both of Silver Spring; John C. Hetzler, Laurel, all of Md.

[73] Assignee: The United States of America as represented by the Secretary of the Navy, Washington, D.C.

[21] Appl. No.: 334,669

[22] Filed: Dec. 30, 1963

[51] Int. Cl.[3] ..... F42B 21/00

[52] U.S. Cl. ..... 102/390; 102/387

[58] Field of Search ..... 340/3, 2; 102/7, 7.2, 102/13, 14, 4, 49, 382, 390–392, 386–387, 394; 244/140, 155; 367/4

[56] References Cited

U.S. PATENT DOCUMENTS

| | | | |
|---|---|---|---|
| 2,151,916 | 3/1939 | Halswit | 102/390 |
| 2,398,794 | 4/1946 | Maltby | 102/411 |
| 2,520,814 | 8/1950 | Rule | 181/142 |
| 2,889,772 | 6/1959 | Howard | 102/390 |
| 3,079,113 | 2/1963 | Meyer, Jr. | 102/377 |
| 3,088,403 | 5/1963 | Bactling | 102/390 |

*Primary Examiner*—Harold J. Tudor

[57] ABSTRACT

An underwater communication system capable of being delivered by a missile for detonating a plurality of charges in a timed sequence. The system includes a main power supply, decelerometer means, separation switch means for electrically interconnecting and energizing the decelerometer means and said main power supply upon receipt of an arming signal from the missile, thermal battery means, means coupled to said decelerometer means for deploying a parachute and for energizing the thermal battery means, timer means for releasing the explosive charges in a predetermined sequence and means couples to the thermal battery means for energizing the timer means.

10 Claims, 4 Drawing Figures

MISSILE DELIVERED EXPLOSIVE SOUND SYSTEM

The invention described herein may be manufactured and used by or for the Government of the United States of America for governmental purposes without the payment of any royalties thereon or therefor.

The invention relates generally to an underwater sound transmitting system capable of missile delivery and more specifically to a communication transmitter capable of detonating explosive sound signals at predetermined intervals, which can be transmitted to distant underwater listening stations.

In accordance with the present invention, the underwater signaling system is arranged within a re-entry body which is carried by a missile and fired thereby causing the re-entry body to become separated from the missile prior to water entry. The underwater explosive sound transmitting system is adapted to operate at a preselected depth and in a prearranged time sequence for transmission of information to underwater locations.

In the past, sound signals have been delivered by surface ships, submarines or aircraft. These systems have, for the most part, been slow in reacting to a command and have been vulnerable to delivery or relay communication countermeasures.

It is one object of the invention to proivde a new and improved underwater explosive signaling device.

Another object is to provide a new and improved underwater signaling device adapted to be carried and delivered by a missile and launched into a body of water after which a plurality of explosive charges are fired in a predetermined time sequence.

Still another object is to provide an underwater signaling device having a fast reaction time and which is substantially less vulnerable to attack during delivery.

A still further object is to provide a re-entry device of improved structural design and capable of withstanding water shock impact without employing air retardation means.

Yet another object of the invention is to provide a re-entry device for housing an underwater sound transmitter and operable to readily release explosive charges therefrom at predetermined intervals.

Other objects and many of the attendant advantages of the invention will be readily appreciated as the same becomes better understood by reference to the following detailed description when considered in connection with the accompanying drawings wherein.

Figure 1:
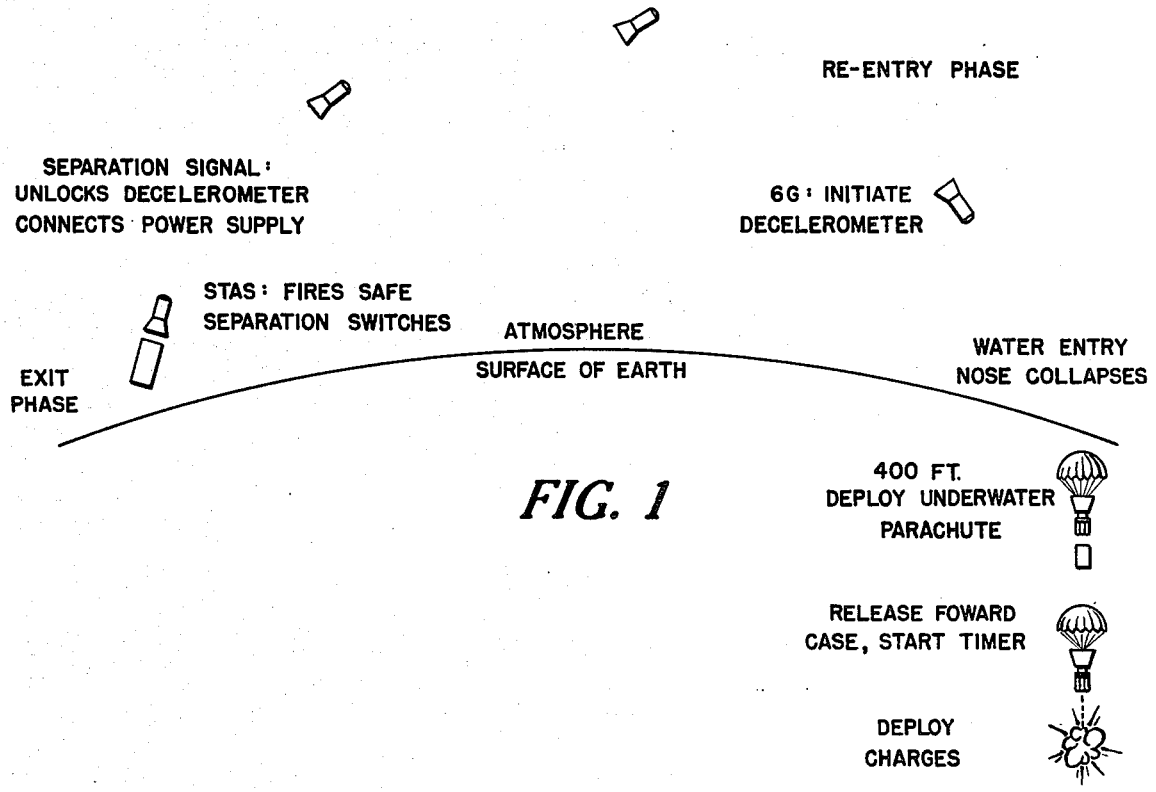
FIG. 1 is a pictorial diagrammatic view in which is shown the missile and the re-entry portion thereof which carries the sound transmitting sysgem of the present invention being launched into the water and employed to transmit signals therefrom.

The underwater communication system relies on the sound waves being transmitted by the so-called bottom bounce, direct transmission, and by the permanent submarine sound channels which permit long range acoustic transmission in deep water. The sound channels within the water generally have their origin in regions having positive pressure gradients and negative temperature gradients above regions of essentially constant temperature. Resulting acoustic velocity profile exhibit minimal loss at particular depths defined as sound channel axes. Sound signals tend to be refracted toward the channel axis from either greater or lesser depths, thereby greatly enhancing horizontal transmission.

Some ocean areas are characterized by multiple sound channels, others by none at all. So-called deep channels, found at depths of 300 meters or more, are regarded as permanent acoustic features from the standpoint of both incidence and configuration. Shallower channels may disappear entirely in winter, or they may be present always while varying substantially in depth. For a reliable long range communication system it is necessary that the channels always be found at some depth in its operational areas. For more limited operationally useful ranges, direct transmission and bottom bounce modes are effective.

The basic acoustic structure of deep ocean areas above latitude 75° is that of a "half-channel" with the axis close to the surface. The term "half-channel" as employed herein may be defined to imply uniformly positive velocity gradients downward from the surface, so that sound is refracted upward from greater depths. This effect, together with the upper channel surface reflection, tends to enhance horizontal transmission, though not as efficiently as do fully submarine channels. Permanent channels at greater depths are found in this region only in those restricted areas where warm water flowing from the Atlantic Ocean to the Norwegian and Greenland Seas retains its identity.

Channel transmission is influenced markedly by bottom topography in areas of shallow water, and the transmitters must be strategically located in operational areas to avoid such acoustic barriers.

Explosions at the sound channel axis are desirable for propagation of maximum energy. However, the depth of detonation can be as shallow as 500 ft. in water of 1,000 fathoms depth without seriously reducing the transmission range. Depths of detonation at considerable distances above the channel axis have been found not to be detrimental.

The minimum spacing between charges is limited by the physical properties of the transmission medium and by the capacity of the detection equipment. The minimum spacing of detonations and the maximum duration of the message, limit the message capability. Therefore, the number of code combinations available is a function of the minimum explosion spacing and the total message duration.

It is necessary therefore, in instances where the explosion spacing is at a minimum that a high degree of accuracy be achieved in the preselection of limited time explosion intervals. The signals from the sound source caused by the explosions travel along a sound channel at a predetermined depth within the body of water and the code will be picked up by a hydrophone located on a submarine or other distant receiving station.

Figure 2:
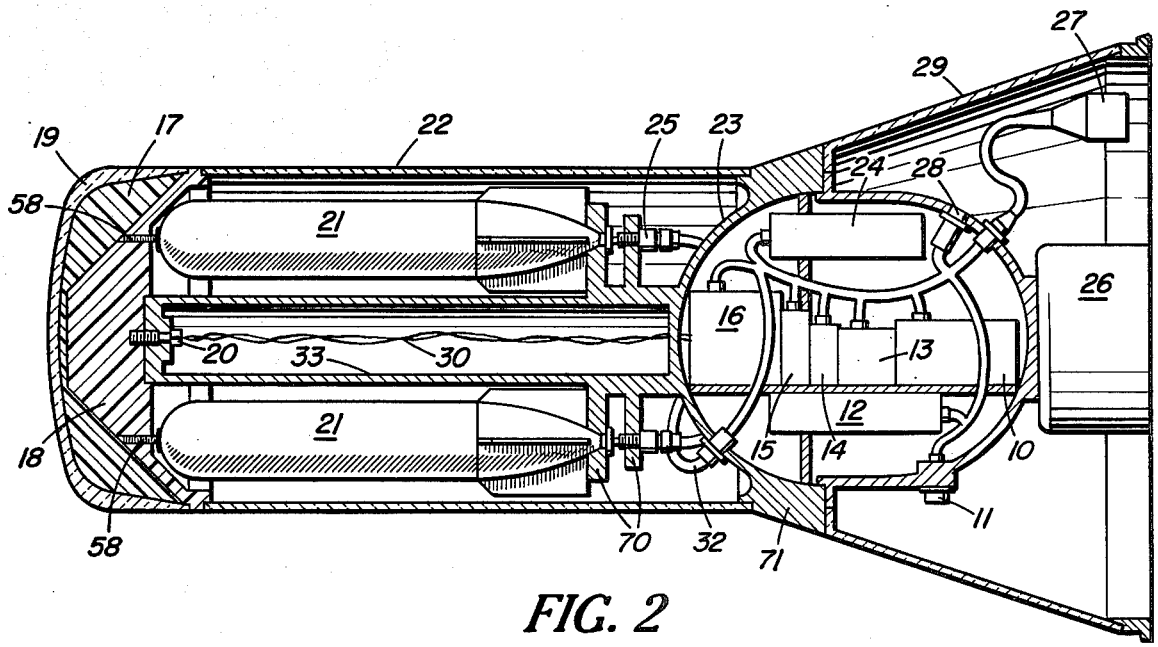
FIG. 2 is an elevational view, partly in section, of the re-entry device of FIG. 1.

Referring now to FIG. 1, there is shown a missile 9 in its exit phase and a re-entry body adapted for separation therefrom having a Fiberglas flare section 29 and an adjoining cylindrical Fiberglas section 22 housing the communication system of the present invention. The re-entry body as shown in FIG. 2 comprises, in addition to the flare section 29 and the cylindrical section 22, a forward portion attached to one end of the cylindrical section 22. This forward portion includes an impact nose 18 having a truncated cone exterior shape and may, for example, be constructed of steel. Surrounding the nose and joining the outer periphery thereof is a frangible Fiberglas heat shield 19, and a foamed plastic material 17 is interposed between the heat shield 19 and the impact nose 18. The heat shield 19 is designed to fragment at water impact, exposing water entry holes, not shown, in the impact nose 18. Subsequently, the impact nose is released by the firing of an explosive bolt 20 or similar explosive device as will be more fully discussed hereinafter with reference to the electrical system. The plane of separation of the forward portion is at the joint of the impact nose 18 and Fiberglas casing 22 and the shape of the impact nose is designed to reduce the axial water entry shock to an estimated peak value of 400 g's. The small flat diameter of nose piece 18 is adequate to maintain stability at water entry for the near vertical entry angle and the impact nose 18 serves, in addition, to support the forward end of the charges 21 secured by jack screw 58.

A central tube 33 is the load bearing member from the impact nose 18 to an instrument case 23 which houses the electrical system therein. The central tube 33 also has extending therefrom mounting surfaces 70 for the charges 21 and the charge release explosive drivers 25.

The instrument compartment 23 is designed for a maximum depth of 2500 feet of water and it forms as a section 71 thereof a coupling joint between the cylindrical section 22 and the flare section 29 of the re-entry body. The oval-shaped compartment 23 has enclosed therein an electrical timer 16, a safe separation switch 15, a decelerometer 13, and a thermal battery 10. These and other electrical components which are housed in the oval-shaped compartment 23, and comprise the electrical system shown in FIG. 3, have electrical connections as will hereinafter be described with reference to FIG. 3.

Figure 3:
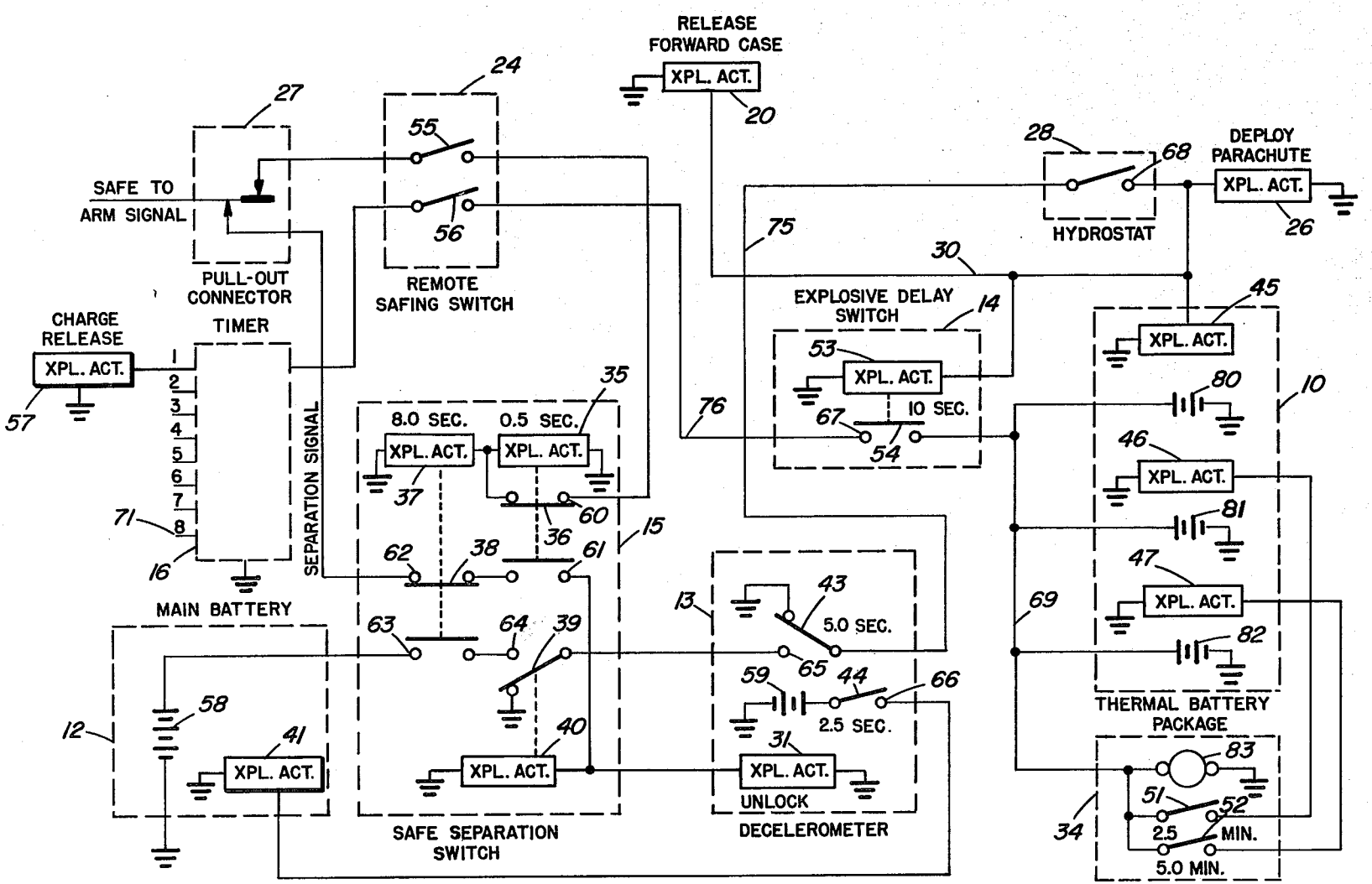
FIG. 3 is the underwater electrical system carried in a compartment of the re-entry body and operable to arm during trajectory and release the explosive charges from said body under water at a preselected depth upon receiving signals in a predetermined timed sequence.
Figure 4:
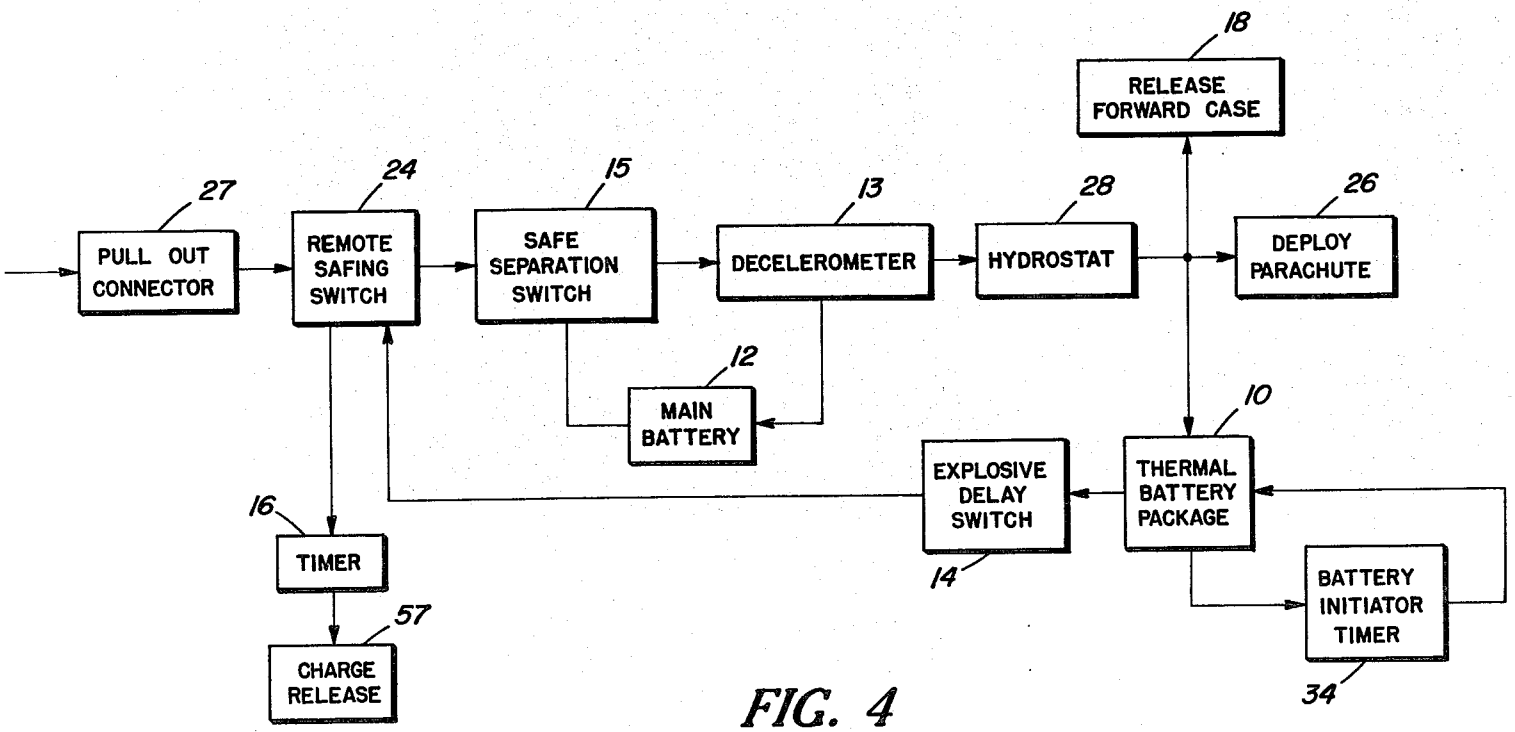
FIG. 4 is a block diagram of the missile delivered explosive sound system.

Prior to launching of the missile, a remote safing switch 24 is armed by closing contacts 55 and 56 and the main timer 16 of the re-entry body is programmed in advance by insertion of the code plug 11 for the charge deployment time sequence desired. The electrical system of FIG. 3 is initially powered by a power supply within the missile, not shown. Thirty seconds before launching, the missile power supply is connected to the electrical section of FIG. 3 by means of a power transfer switch (not shown) and driven by a voltage source within the missile external to the electrical system. The safe-to-arm signal (STAS) which is applied to the pull-out connector 27 is a voltage derived from the missile power supply and is applied through a switch and a relay within the missile. The operation of the missile relay is controlled by an acceleration sensing device (not shown) and the acceleration sensing device operates shortly after missile launching to close the missile relay.

The guidance system of the missile controls the STAS switch within the missile upon determination that the missile is on course. With this requirement met, the STAS switch is closed applying the STAS to the pull-out connector 27. The safe-to-arm signal (STAS) is applied between 4.5 and 0.8 seconds prior to the separation of the re-entry body from the missile. Thereafter, another signal is derived from the guidance system of the missile to effect separation of the re-entry body therefrom. The STAS signal applied to the pull-out connector 27 is conducted by the contact 55 of the remote safing switch 24 to the safe separation switch assembly 15 and is applied simultaneously to explosive elements 35 and 37. These explosive elements drive contacts 36 and 38 of the 0.5 and 8.0 second relays. Prior to the operation of the pull-out connector 27, the safe-to-arm signal (STAS) derived from the missile power supply provides the initiating signal for the safe separation switch 15. The explosive element and driver (or pyrotechnic switch) 35 operates 0.5 second after application of the STAS thereto to shift contact 36 from terminals 60 to terminals 61 and explosive switch 37 operates 8.0 seconds after the initial application of the STAS thereto to shift contact 38 from terminals 62 to terminals 63. During this interval between 0.5 second and 8.0 seconds there is a conductive path between the pull-out connector 27 through terminals 62 and 61 to the explosive 40 within the safe separation switch assembly and to the explosive release or unlocking means 31 within the decelerometer assembly 13. During this interval, explosive 40, which may also be a pyrotechnic switch, operates to close contact 39 and bring contact 39 into electrical connection with terminal 64. Contact 39 closes prior to closure of contact 38 against terminals 63, the latter being operated by the explosive 37 of the eight-second dropout relay.

After the explosive 40 and the explosive unlocking means 31 have been operated, the safe-to-arm signal has served its useful purpose and the circuit at 27 is opened by removal of the connector. This signal is applied between 4.5 and 0.8 seconds prior to the separation of the re-entry body from the missile, and at approximately 0.8 seconds prior to the separation of the re-entry body, the connector 27 is pulled out.

After the unlocking of explosive releasing means 31 has been operated by the STAS to render the decelerometer operable, and upon the re-entry body experiencing a deceleration of 6 g for 2.5 seconds, pulse battery 59 is connected to explosive 41 of the main battery. This occurs approximately 2.5 seconds after a continuous deceleration of 6 g's, and by motion of a movable mass (not shown) within the decelerometer assembly 13, pulse battery 59 is ignited, and switch 44 is closed.

The voltage derived from the pulse battery 50 is applied to explosive 41 within the main battery 12 to energize battery 12 and render the battery voltage 58 available at terminal 65 within the decelerometer means 13. The five-second switch of the decelerometer is closed when the re-entry body has experienced a deceleration of 6 g for five-seconds and such closure is also affected by the motion of a moveable mass (not shown) within the decelerometer 13. Closure of the five-second switch 43 makes the main battery voltage 12 of the re-entry body available at the hydrostat 28 via conductor 75.

The re-entry body enters the air-water interface and sinks to a depth of approximately 400 feet where the hydrostat closes applying the main battery 12 power to explosive means 26 for deploying the underwater parachute. Simultaneously, the main battery voltage is applied via conductor 30 to explosive means 20 for releasing the impact nose or forward release case 18. Such release is effected by means of explosive bolt 20 as shown in FIG. 2. The thermal battery package 10 comprises separate cells 80, 81, and 82 which form separate thermal batteries within the package 10. Upon application of the main battery voltage to the thermal package, explosive means 45 is energized initially to activate thermal battery 80. Battery voltage 80 is made available through conductor 69 at the battery initiated timer element 83 of the timer 34. Timing element 83 thereafter closes contacts 51 and 52, respectively, in sequence in two and one-half minute intervals providing a source of energy for explosive initiator elements 46 and 47 two and one-half minutes and five minutes, respectively, after initial energization of explosive element 45. Explosive initiator elements 45, 46 and 47 are operatively associated with the thermal batteries 35, 36 and 37, respectively, and provide a means for converting, through combustion, the solid electrolyte of each of these thermal batteries into a liquid electrolyte thereby activating each of the batteries in succession. Battery power is supplied by the thermal battery package 10 continuously by the parallel connected thermal batteries 80, 81 and 82 therein.

The explosive delay switch 14 includes an explosive 53 providing a ten-second delay and is energized immediately after closure of the hydrostat 28. The ten-second delay allows the thermal battery 80 to attain its rated voltage prior to the application thereof to the main timer 16 via conductor 76. Thereafter voltage from the thermal battery 80 powers the battery initiator timer 34 and the main timer 16. The main timer 16 may, for example, be of the conventional electromechanical type and is operable to deploy charges in accordance with its preset schedule. A plurality of output connections 71 interconnect the timer 16 with any convenient explosive charge release means 57, which may for example comprise an explosive driver 25 such as shown in FIG. 2. Deployment of the underwater parachute retards the sinking rate of the re-entry body to approximately one-foot per second and prior release of the forward case or impact nose 18 renders the charges exposed for deployment from the re-entry body. The charges are deployed by signals from the main timer 16 and the release of an individual charge 21 allows hydrostatic pressure to actuate an arming device (not shown) within the individual charges. The arming device initiates a five-second pyrotechnic delay column in a firing train of the charge 21. Burnout of a pyrotechnic delay column (not shown) within the individual charges initiates a charge detonator (not shown) and the explosion of the individual charge detonators takes place in a delayed time sequence identical to the timed sequence of the preset timer previously initiated to release the charges 21.

The last charge released from the re-entry body is equipped with a restraining line (not shown) limiting its separation from the sinking re-entry body to a distance of about two and one-half feet. Detonation of this charge provides the last signal and scuttles the re-entry body.

Obviously many modifications and variations of the present invention are possible in the light of the above teachings. For example, any effective means may be resorted to in each of the component parts of the electrical system of FIG. 3 to provide the desired timed delayed switching action therein. Various types of electrical and electromechanical timers may be used to provide the desired prescheduled timed sequence of output signals to the charge release means, and any convenient internal power supply initiating means may be employed within the thermal battery package without departing from the spirit and scope of the invention. It is therefore to be understood, that within the scope of the appended claims, the invention may be practiced otherwise than as specifically described.

We claim:

1. An underwater communication system capable of missile delivery for releasing explosive charges in timed sequence comprising;

a main power supply, decelerometer means, separation switch means for electrically interconnecting and energizing said decelerometer means and said main power supply upon receipt of an arming signal from said missile, thermal battery means, means coupled to said decelerometer means for deploying a parachute and for energizing said thermal battery means, timer means for releasing said explosive charges in a predetermined sequence, and means coupled to said thermal battery means for energizing said timer means.

2. The system of claim 1 which further includes, connector means coupled to said separation switch means and adapted to provide a conductive path between said separation switch means and the missile power supply for a predetermined time interval.

said separation switch means further including first relay means operable after a first preselected time delay to provide an electrical connection between said main power supply and said decelerometer means, and time delay switching means coupled to said decelerometer means for electrically interconnecting said means for deploying and energizing said main power supply after a second preselected time delay.

3. The combination of claim 2 which further includes, release means coupled to said decelerometer means for unlocking said decelerometer upon receipt of an electrical signal from said missile and applied through said separation switch means.

4. The system of claim 3 which further includes, thermal battery initiating means coupled to said thermal battery means for continuously interconnecting said thermal battery means to said timer means and explosive delay switch means adapted to be energized by said main power supply and coupled between said thermal battery means and said timer means for enabling said thermal battery means to reach a predetermined voltage prior to energization of said timer means.

5. The system of claim 4 wherein said means for deploying and energizing comprise, a hydrostat operable to close a circuit between said decelerometer means and said thermal battery means when subjected to a predetermined hydrostatic pressure, end casing means positioned adjacent said charges for retaining said charges and preventing water entry upon said charges prior to the release thereof, and means responsive to operation of said hydrostat for releasing said end casing means.

6. The system of claim 5 which further includes, moveable means coupled to said decelerometer means for operatively energizing said time delay switching means upon experiencing a predetermined deceleration for a predetermined period.

7. A system of claim 6 wherein said moveable means comprises a moveable mass operatively coupled to said time delay switching means for closing said time delay switching means between a pulse battery means within said decelerometer means and said main power supply upon experiencing a predetermined deceleration.

8. The combination of claim 5 which includes in addition;

a hollow compartment enclosing said communication system, a hollow flare-type casing having one end thereof mounted on said compartment, a cylindrical casing abutting said flare-type casing at said one end thereof and mounted on said compartment, a plurality of charges releasably mounted in said cylindrical casing, said end casing means including impact nose means abutting one end of said cylindrical casing, and a load bearing member centrally positioned within said cylindrical casing and structurally connected at the respective ends thereof to said impact nose means and said compartment, said means for releasing said end casing means coupled to said main power supply means for shearing said impact nose means away from said cylindrical casing.

9. The combination of claim 8 wherein said means for shearing comprises an explosive bolt joining one end of said load bearing member and said impact nose means and adapted to be energized by said main power supply whereby said impact nose means will be released from said cylindrical casing.

10. The combination of claim 8 wherein said end casing means further includes;

a frangible shield covering one end of said impact nose means and adapted to frangment at water impact, and charge release means connected between said timer means and said charges for releasing said charges at predetermined time intervals whereby said charges will be released from within said cylindrical casing in a predetermined timed sequence.

* * * * *